US008834052B2

(12) United States Patent
Kim

(10) Patent No.: US 8,834,052 B2
(45) Date of Patent: Sep. 16, 2014

(54) LIP GLOSS TUBE CAPABLE OF GUIDING AN APPLICATOR TO THE NOZZLE OF A BODY USING MAGNETIC FORCE

(75) Inventor: Min Ji Kim, Seoul (KR)

(73) Assignee: Amorepacific Corporation, Seoul (KR)

( * ) Notice: Subject to any disclaimer, the term of this patent is extended or adjusted under 35 U.S.C. 154(b) by 355 days.

(21) Appl. No.: 13/504,663

(22) PCT Filed: Oct. 29, 2010

(86) PCT No.: PCT/KR2010/007501
§ 371 (c)(1),
(2), (4) Date: Apr. 27, 2012

(87) PCT Pub. No.: WO2011/053031
PCT Pub. Date: May 5, 2011

(65) Prior Publication Data

US 2012/0219345 A1 Aug. 30, 2012

(30) Foreign Application Priority Data

Oct. 30, 2009 (KR) ..... 20-2009-0014139 U

(51) Int. Cl.
*A46B 11/00* (2006.01)
*A45D 40/26* (2006.01)
*A45D 40/18* (2006.01)

(52) U.S. Cl.
CPC ..... *A45D 40/26* (2013.01); *A45D 40/18* (2013.01)
USPC ..... 401/126; 132/317

(58) Field of Classification Search
CPC ..... A45D 40/26; A45D 40/18
USPC ..... 401/126–130; 132/317–318; 206/350, 206/818
See application file for complete search history.

(56) References Cited

U.S. PATENT DOCUMENTS

| | | | | |
|---|---|---|---|---|
| 6,588,958 | B1 * | 7/2003 | Seidler | 401/100 |
| 7,918,620 | B2 * | 4/2011 | Del Ponte | 401/131 |
| 2006/0272667 | A1 | 12/2006 | Wyatt et al. | |

FOREIGN PATENT DOCUMENTS

| | | | |
|---|---|---|---|
| JP | 2003-259913 | A | 9/2003 |
| JP | 2006-346469 | A | 12/2006 |
| WO | 03-093027 | A1 | 11/2003 |

OTHER PUBLICATIONS

International Search Report of PCT/KR2010/007501.

* cited by examiner

*Primary Examiner* — David Walczak
*Assistant Examiner* — Jennifer C Chiang
(74) *Attorney, Agent, or Firm* — Maxon IP LLC.; Justin H. Kim

(57) ABSTRACT

A lip gloss case for guiding an applying tip into an entry of a main body, includes: a main body accommodating cosmetics; an applying tip inserted into an entry of the main body to apply the cosmetics to user's skin; a first magnetic material provided in the applying tip; and a second magnetic material provided on the entry of the main body and attracting the first magnetic material in the applying tip to guide the first magnetic material into the entry of the main body. By doing so, due to the attractive force between the first magnetic material and the second magnetic material which are respectively provided in the applying tip and on the entry of the main body, an eye handicapped person or the old suffering from eyesight or tremor of the hand may easily insert the applying tip into the entry of the main body.

4 Claims, 4 Drawing Sheets

LIP GLOSS TUBE CAPABLE OF GUIDING AN APPLICATOR TO THE NOZZLE OF A BODY USING MAGNETIC FORCE

BACKGROUND OF THE INVENTION

1. Field of the Invention

The present invention relates to a lip gloss case, and more particularly, to a lip gloss case including a main body that contains cosmetics such as lip gloss and an applying tip inserted into an entry of the main body to apply the cosmetics to user's skin such as lips, wherein the applying tip is attracted by a magnetic force and is easily guided into the entry of the main body when the applying tip is inserted into the main body from the outside.

2. Description of the Related Art

In general, lips can remain beautiful only when are wet with moisture and a lip gloss is applied to lips to maintain the wet and beautiful lips. Cosmetic such as lip gloss includes an applying tip formed on a tool rod of a preset length to easily apply the lip gloss to corresponding skin, wherein the applying tip is inserted into an entry of a main body accommodating cosmetics together with the tool rod to smear the cosmetics. That is, the main body accommodating cosmetics such as lip gloss is made of glass or synthetic resin to define a preset accommodating chamber, a tool rod screwed on the entry of the main body and applying the cosmetics with a lower end thereof, and a cap including an applying tip such as sponge formed at the end of the tool rod.

According to this existing lip gloss case, the cap screwed on the main body is separated from the entry of the main body, cosmetics is applied to the applying tip of the tool rod provided at the lower end of the cap, the applying tip is applied to corresponding skin, that is, lips, and after that, the tool rod is inserted into the main body for the custody.

In this case, the entry formed in the main body has a diameter through which the applying tip passes with difficulty to minimize contact between the cosmetic in the main body and ambient air so that the cosmetics in the main body may be prevented from changing in quality.

However, the existing lip gloss case is difficult that a user who has a trouble in eyesight, that is, an eye handicapped person and the old inserts the applying tip into the entry of the main body again.

In other words, since diameters of the applying tip and the entry of the main body are not sufficient such that a user easily inserts the applying tip into the entry, the user may need high concentration to insert the applying tip after taking the applying tip out of the main body to apply the cosmetics to skin and inserting the applying tip into the entry again.

Thus, if a user cannot concentrate, cosmetics on the applying tip is stuck around the entry of the lip gloss case so that the cosmetics on the lip gloss case make cloth and/or other articles be contaminated.

Particularly, when a user suffers from tremor of the hand, it is difficult to use for a considerable time to insert the applying tip into the entry.

BRIEF SUMMARY OF THE INVENTION

The present invention has been made to overcome the above problem and provide a lip gloss case for attracting an applying tip to an entry of a main body of the lip gloss case and for guiding the applying tip into the entry when an eye handicapped person and/or the old approaches the applying tip including a tool rod to the entry of the main body of the lip gloss case in which cosmetics is accommodated.

In order to achieve the foregoing and/or other aspects of the present invention, there is provided a lip gloss case for guiding an applying tip using a magnetic force, including: a main body accommodating cosmetics; an applying tip inserted into an entry of the main body to apply the cosmetics to user's skin; a first magnetic material provided in the applying tip; and a second magnetic material provided on the entry of the main body and attracting the first magnetic material in the applying tip to guide the first magnetic material into the entry of the main body.

Here, the entry of the main body may include a slope inclined from an end to the other end.

Moreover, the second magnetic material may have the same shape as that of the entry of the main body and is insert-molded together with the main body.

In addition, the second magnetic material may be installed on the inner circumference of the entry.

According to the lip gloss case for guiding an applying tip to an entry of a main body using a magnetic force, an eye handicapped person and/or the old may easily insert the applying tip into the entry of the main body using an attractive force between a first magnetic material and a second magnetic material that are provided at the applying tip and the entry of the main body.

BRIEF DESCRIPTION OF THE DRAWINGS

The objects, features and advantages of the present invention will be more apparent from the following detailed description in conjunction with the accompanying drawings, in which.

DETAILED DESCRIPTION OF THE INVENTION

Particular terms may be defined to describe the invention in the best manner. Accordingly, the meaning of specific terms or words used in the specification and the claims should not be limited to the literal or commonly employed sense, but should be construed in accordance with the spirit of the invention.

Hereinafter, the embodiment of the present invention will be described in detail with reference to the accompanying drawings so that those skilled in the art may easily practice the present invention.

Figure 1:
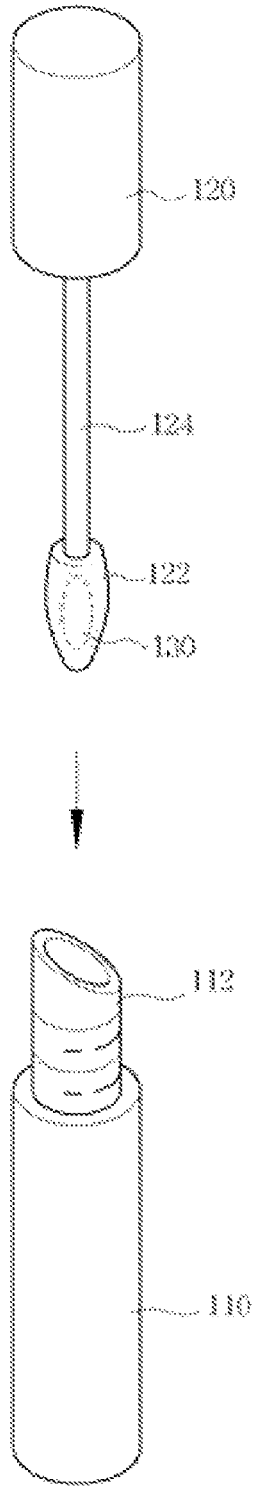
FIG. 1 is a perspective view illustrating a lip gloss case according to an exemplary embodiment of the present invention.
Figure 2:
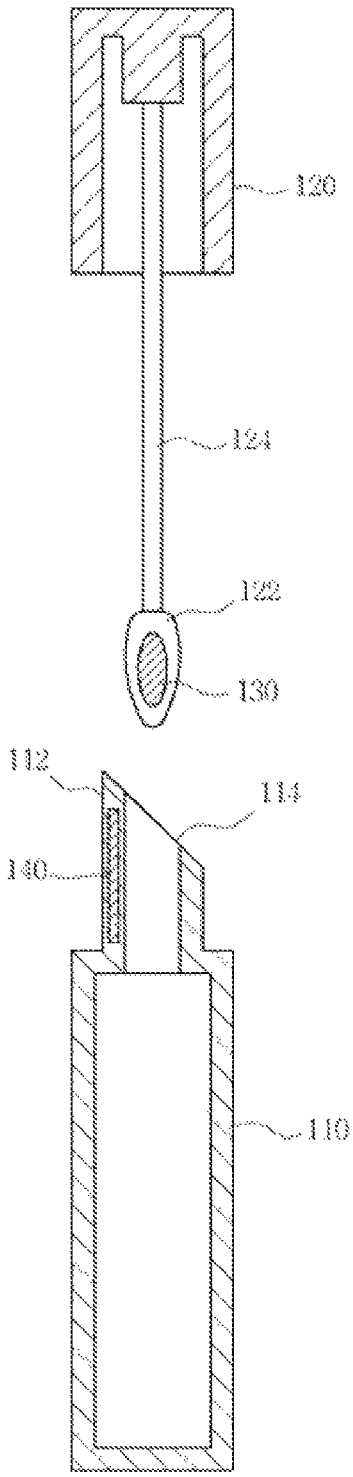
FIG. 2 is a sectional view illustrating a lip gloss case according to an exemplary embodiment of the present invention.

FIG. 1 is a perspective view illustrating a lip gloss case according to an exemplary embodiment of the present invention. FIG. 2 is a sectional view illustrating a lip gloss case according to an exemplary embodiment of the present invention.

With reference to FIGS. 1 and 2, a lip gloss case for guiding an applying tip to an entry of a main body using a magnetic force according to an exemplary embodiment of the present invention includes a main body 110 formed with an entry 112 through which cosmetics such as lip gloss is inserted and taken out of and a cap 120 screwed on the entry 112 to close and open the entry 112.

The cap 120 is provided with a tool rod 124 of a preset length integrated with the cap 120 to allow a user to apply cosmetics such as lip gloss to a corresponding portion conveniently, wherein the tool rod 124 includes an applying tip 122 provided at an end of the tool rod 124 to apply cosmetics to lips.

That is, as illustrated in FIG. 1 or 2, the applying tip 122 is formed at the end of the tool rod 124 and includes a first magnetic material 130 provided therein.

Moreover, the main body 110 has an accommodating chamber to accommodate cosmetics such as lip gloss and the entry 112 through which the applying tip 122 with cosmetics enters and exits.

The entry 112 is formed with threads screwed with the cap 120 and female threads on the lower inner circumference of the cap 120 to be screwed with the threads of the entry 112 so that the main body 110 and the cap 120 can be screwed with each other for the custody.

The applying tip 122 including the tool rod 124 enters and exits through the entry of the main body 110 to apply cosmetics to lips.

Here, the applying tip 122 is formed with the first magnetic material 130 and the entry 112 of the main body 110 through which the applying tip 122 enters and exits is formed with a second magnetic material 140 to attract the first magnetic material 130.

Thus, when the applying tip 122 approaches the entry 112 of the main body 110, the first magnetic material 130 and the second magnetic material 140 attract each other due to the magnetic force therebetween so that the applying tip 122 may be easily inserted into the main body 110.

In other words, the applying tip 122 is made of porous material smearing cosmetics such as sponge and includes the first magnetic material 130 reacting with a magnetic force such as a magnet or metal, and the entry 112 of the main body 110 through which the applying tip 122 enters and exits is provided with the second magnetic material 140 generating an attractive force of attracting the first magnetic material 130 to attract the applying tip 122 toward the entry 112 as the applying tip 122 approaches the entry 112 such that the applying tip 122 may be easily inserted into the main body 110.

Here, in a case where the first magnetic material 130 in the applying tip 122 is a magnet, the second magnetic material 140 on the entry 112 of the main body 110 has a polarity different from that of the first magnetic material 130 so that an attractive force attracting the applying tip 122 toward the entry 112 of the main body 110 may be obtained.

In addition, if the first magnetic material 130 is metal, the second magnetic material 140 on the entry 112 of the main body 110 is made of a magnet so that the applying tip 122 approaches the entry 112 of the main body 110 by the attractive force from the second magnetic material 140 so that the applying tip 122 is attracted into the entry 112 and then is easily inserted into the main body 110.

Here, preferably, as the applying tip 122 approaches the entry 112 of the main body 110, a magnetic force may be generated between the applying tip 122 and the entry 112 only in the direction where the applying tip 122 is easily inserted into the main body 110.

For example, the second magnetic material 140 on the entry 112 of the main body 110 may include a shield material (not shown) blocking the magnetic force between the outer circumference of the entry 112 and the second magnetic material 140 such that the magnetic force exhibits toward the inner circumference of the entry 112 or a wall of increased thickness between the second magnetic material 140 and the entry 112 such that the magnetic force of the second magnetic material 140 does not have influence to the outer circumference of the entry 112.

Particularly, the entry 112 of the main body 110 includes a sloe 114 inclined from an end to the other end such that the applying tip 122 may be easily inserted into the entry 112 of the main body 110 when the attractive force is generated by the first magnetic material 130 in the applying tip 122 and the second magnetic material 140 on the entry 112.

By doing so, when the applying tip 122 approaches the entry 112 of the main body 110 and is positioned on the upper end of the entry 112, the applying tip 122 is guided along the slope 114 on the upper end of the entry 112 so that the applying tip 122 may be easily inserted into the main body 110.

According to the lip gloss case using a magnetic force according to the exemplary embodiment of the present invention, thanks to the attractive force generated between the first magnetic material 130 in the applying tip 122 and the second magnetic material 140 on the entry 112 of the main body 110, an eye handicapped person or the old who suffers from tremor of the hand may easily insert the applying tip 122 into the main body 110 through the entry 112 of the main body 110.

While this invention has been particularly shown and described with reference to preferred embodiments thereof, these embodiments are provided so that this disclosure will be thorough and complete, and will fully convey the concept of the invention to those skilled in the art. It will be understood by those skilled in the art that various changes in form and details may be made therein without departing from the spirit and scope of the invention as defined by the appended claims.

Figure 3:
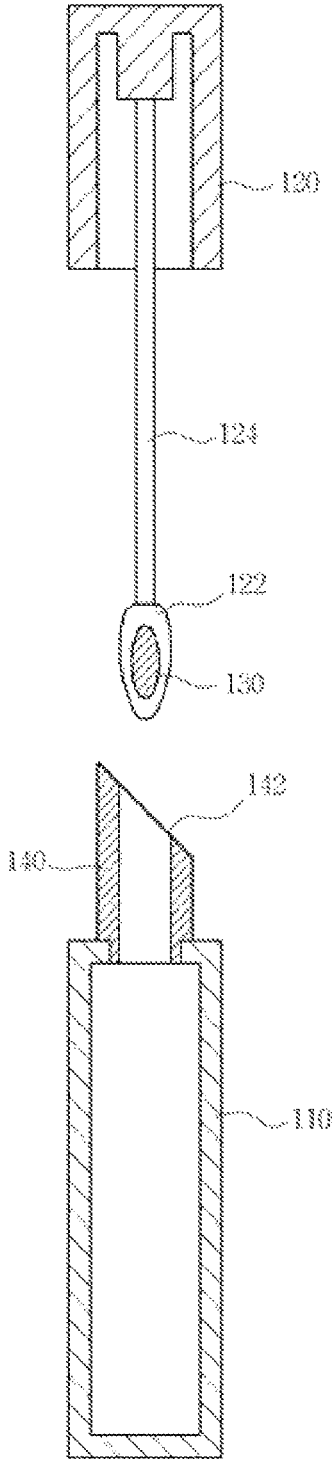
FIG. 3 is a sectional view illustrating a lip gloss case according to another exemplary embodiment of the present invention.
Figure 4:
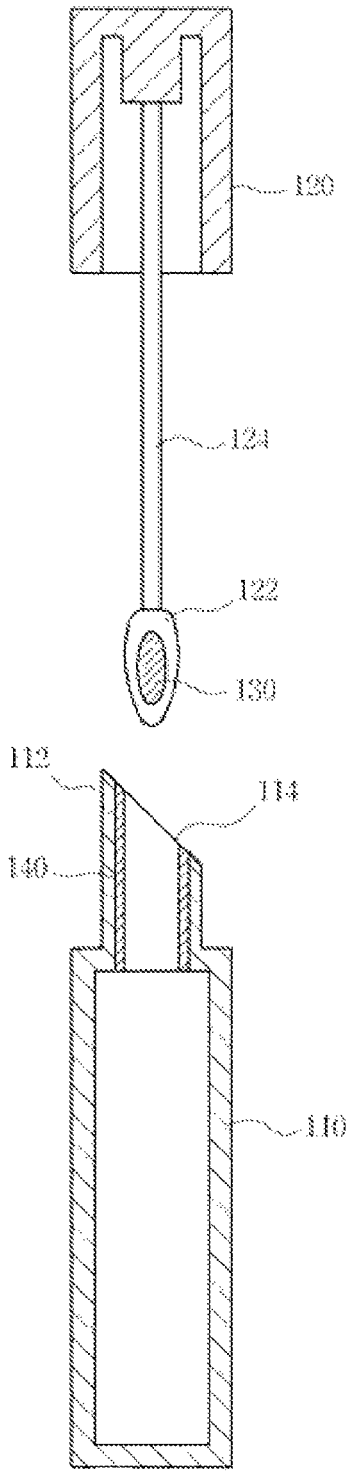
FIG. 4 is a sectional view illustrating a lip gloss case according to still another exemplary embodiment of the present invention.

For example, the second magnetic material 140 on the entry 112 of the main body 110, as illustrated in FIG. 3 or FIG. 4, has the same shape as that of the entry 112 of the main body 110 so that various aesthetical appearing outlets of the lip gloss case may be provided to a user, that more convenient injection mold may improve productivity, or that the second magnetic material 140 is provided on the outer circumference instead of on the entry 112 of the main body 110 such that the magnetic force generated from the second magnetic material 140 exerts toward the inner circumference of the entry 112. This will be described with reference to FIGS. 3 and 4.

FIG. 3 is a sectional view illustrating a lip gloss case according to another exemplary embodiment of the present invention. Referring to FIG. 3, a lip gloss case according to another exemplary embodiment of the present invention includes a main body 110 provided with a second magnetic material 140 made of metal or a magnet having the same shape as that of the entry of the main body 110. The second magnetic material 140 is inserted into a mold of an injection molding machine (not shown) for injecting the main body and the main body except the entry is inject-molded.

The upper end of the second magnetic material 140 having the same shape as that of the entry includes a slope 142 inclined from an end to the other end such that the applying tip 122 may be easily inserted into the main body when the applying tip 122 approaches the entry 112 of the main body 110 and is positioned on the upper end of the second magnetic material 140.

By insert-molding the second magnetic material 140 having the same shape as that of the entry together with the main body 110, the first magnetic material 130 in the applying tip 122 approaches the second magnetic material 140 having the same shape as that of the entry and is easily inserted into the main body by the attractive force generated between the first magnetic material 130 and the second magnetic material 140.

Since the second magnetic material 140 having the same shape as that of the entry can be changed and modified in various designs, the aesthetical appearing outlet may be provided to a user and the injection mold is improved more conveniently resulting in increasing productivity.

FIG. 4 is a sectional view illustrating a lip gloss case according to still another exemplary embodiment of the present invention. Referring to FIG. 4, a lip gloss case according to still another exemplary embodiment of the present invention includes a second magnetic material 140 provided on the inner circumference of the entry 112 of the main body 110.

By doing so, since a wall between the second magnetic material 140 and the outer circumference of the entry 112 may be thicker, the magnetic force generated from the second magnetic material 140 does not exert the outer circumference of the entry 112 while the magnetic force generated from the second magnetic material 140 may exert toward the inner circumference of the entry 112, so that the applying tip 122 may be securely guided into the inner circumference of the entry 112 and that the applying tip 122 may be inserted into the main body 110 conveniently.

What is claimed is:

1. A lip gloss case for guiding an applying tip using a magnetic force, comprising:

a main body (110) accommodating cosmetics;

an applying tip (122) inserted into an entry (112) of the main body (110) to apply the cosmetics to user's skin;

a first magnetic material (130) provided in the applying tip (122); and a second magnetic material (140) provided on the entry (112) of the main body (110) and attracting the first magnetic material (130) in the applying tip (122) to guide the first magnetic material (130) into the entry (112) of the main body (110).

2. The lip gloss case of claim 1, wherein the entry (112) of the main body (110) includes a slope (114) inclined from an end to the other end.

3. The lip gloss case of claim 1 or claim 2, wherein the second magnetic material (140) has the same shape as that of the entry (112) of the main body (110) and is insert-molded together with the main body (110).

4. The lip gloss case of claim 1 or claim 2, wherein the second magnetic material (140) is installed on the inner circumference of the entry (112).

* * * * *